US010843258B2

(12) United States Patent
Tetkoskie et al.

(10) Patent No.: US 10,843,258 B2
(45) Date of Patent: Nov. 24, 2020

(54) MULTI-CHAMBER MOLTEN METAL PUMP

(71) Applicant: PYROTEK, INC., Spokane, WA (US)

(72) Inventors: Jason Tetkoskie, Cleveland Heights, OH (US); Richard S. Henderson, Solon, OH (US)

(73) Assignee: Pyrotek, Inc., Spokane, WA (US)

( * ) Notice: Subject to any disclaimer, the term of this patent is extended or adjusted under 35 U.S.C. 154(b) by 70 days.

(21) Appl. No.: 16/312,758

(22) PCT Filed: Jun. 21, 2017

(86) PCT No.: PCT/US2017/038427
§ 371 (c)(1),
(2) Date: Dec. 21, 2018

(87) PCT Pub. No.: WO2017/223136
PCT Pub. Date: Dec. 28, 2017

(65) Prior Publication Data

US 2019/0351481 A1 Nov. 21, 2019

Related U.S. Application Data

(60) Provisional application No. 62/352,786, filed on Jun. 21, 2016.

(51) Int. Cl.
*F04D 7/06* (2006.01)
*B22D 39/00* (2006.01)
(Continued)

(52) U.S. Cl.
CPC ..... *B22D 39/00* (2013.01); *F04D 3/005* (2013.01); *F04D 7/065* (2013.01); *F04D 29/406* (2013.01);
(Continued)

(58) Field of Classification Search
CPC ..... F04D 7/065; F04D 13/08; F04D 25/0686; F04D 29/026; F04D 29/4293; F04D 29/628; F05D 2250/52
See application file for complete search history.

(56) References Cited

U.S. PATENT DOCUMENTS 2,468,704 A * 4/1949 Pippin ..... F27D 3/14 417/423.12
3,010,402 A * 11/1961 King ..... F04D 7/065 415/131
(Continued)

FOREIGN PATENT DOCUMENTS

WO 9304283 A1 3/1993

OTHER PUBLICATIONS

International Search Report and Written Opinion of the International Searching Authority for PCT/US2017/038427, dated Oct. 27, 2017, 19 pages.

*Primary Examiner* — Ninh H. Nguyen
(74) *Attorney, Agent, or Firm* — Fay Sharpe LLP

(57) ABSTRACT

In accordance with one aspect of the present exemplary embodiment, a molten metal pump comprising a refractory material body defining an elongated chamber is provided. The chamber is configured to receive a shaft and impeller assembly. The chamber includes an open top through which the shaft passes and a bottom inlet. The impeller is located in or adjacent the inlet. The body further defines an elongated passage adjacent to the chamber. An opening provides fluid communication between the elongated passage and the elongated chamber. The elongated passage is in fluid communication with a discharge channel configured to direct molten metal at least substantially perpendicular to an elongated axis of the elongated chamber.

17 Claims, 5 Drawing Sheets

(51) Int. Cl.
*F04D 3/00* (2006.01)
*F04D 29/40* (2006.01)

(52) U.S. Cl.
CPC ..... *F05D 2300/13* (2013.01); *F05D 2300/20* (2013.01); *F05D 2300/30* (2013.01)

(56) References Cited

U.S. PATENT DOCUMENTS

| | | | | | |
|---|---|---|---|---|---|
| 3,836,280 | A * | 9/1974 | Koch | F04D 7/065 | 415/175 |
| 4,475,866 | A * | 10/1984 | Kambe | F04D 29/047 | 415/112 |
| 5,716,195 | A | 2/1998 | Thut | | |
| 6,187,096 | B1 * | 2/2001 | Thut | B05B 1/14 | 118/300 |
| 8,337,746 | B2 * | 12/2012 | Cooper | C22B 21/0084 | 266/239 |
| 9,470,239 | B2 * | 10/2016 | Cooper | C04B 37/025 | |
| 2008/0314548 | A1 | 12/2008 | Cooper | | |
| 2010/0084440 | A1 | 4/2010 | Mordue | | |
| 2011/0303706 | A1 | 12/2011 | Cooper | | |
| 2013/0101424 | A1 | 4/2013 | Bright et al. | | |

* cited by examiner

MULTI-CHAMBER MOLTEN METAL PUMP

BACKGROUND

The present exemplary embodiment relates to a molten metal pump. It finds particular application in conjunction with lifting molten metal from a vessel, and will be described with reference thereto. However, it is to be appreciated that the present exemplary embodiment is also amenable to other like applications.

A reverbatory furnace is used to melt metal and retain the molten metal while the metal is in a molten state. As used herein, the term "molten metal" means any metal or combination of metals in liquid form, such as aluminum, copper, iron, zinc, magnesium and alloys thereof. Reverbatory furnaces usually include a chamber containing a molten metal pump, sometimes referred to as a pump well. The pump is utilized for numerous purposes including circulation of the molten metal bath in the furnace, for introduction of metal treatment agents such as chlorine gas, and for removal of the molten metal from the furnace.

Pumps for pumping molten metal typically include a base. Such pumps also include one or more inlets in the pump base which allow molten metal to enter the pump chamber. An impeller is mounted in the pump chamber and is connected to a drive shaft. The drive shaft is typically coupled to a motor. As the motor turns the shaft, the shaft turns the impeller and the impeller pushes molten metal out of the pump chamber.

Molten metal pump casings and impellers usually employ a bearing system comprising ceramic rings wherein one or more rings on the impeller align with one or more rings in the pump base. The purpose of the bearing system is to reduce damage to the components, particularly the rotor and pump chamber wall, during pump operation.

The materials forming the molten metal pump components that contact the molten metal bath should remain relatively stable in the bath. Structural refractory materials, such as graphite or ceramic, that are resistant to disintegration by corrosive attack from the molten metal may be used.

Molten metal transfer pumps have been used, among other things, to transfer molten aluminum from a furnace well to a ladle or launder from where it is cast in molds into solid, pieces such as ingots. A ladle is a large vessel into which molten metal is poured from the furnace. After molten metal is placed into the ladle, the ladle is transported from the furnace area to another part of the facility where the molten metal inside the ladle is poured into molds. The launder is essentially a trough, channel or conduit outside of the reverbatory furnace.

Currently, many metal die casting facilities employ a main hearth containing the majority of the molten metal. Solid bars of metal may be periodically melted in the main hearth. A transfer pump is located in a separate well adjacent the main hearth. The transfer pump draws molten metal from the well in which it resides and transfers it into a ladle or launder and from there to die casters that form the metal articles. The present disclosure relates to pumps used to transfer molten metal by lifting it from a furnace for transport to a die casting machine, ingot mold, DC caster or the like.

One type of transfer pump is described in U.S. Published Application 2008/0314548, the disclosure of which is herein incorporated by reference. The system comprises at least (1) a vessel for retaining molten metal, (2) a dividing wall (or overflow wall) within the vessel, the dividing wall having a height H1 and dividing the vessel into a least a first chamber and a second chamber, and (3) a molten metal pump in the vessel, preferably in the first chamber. The second chamber has a wall or opening with a height H2 that is lower than height H1 and the second chamber is juxtaposed another structure, such as a ladle or launder, into which it is desired to transfer molten metal from the vessel. The pump (either a transfer, circulation or gas-injection pump) is submerged in the first chamber and pumps molten metal from the first chamber past the dividing wall and into the second chamber causing the level of molten metal in the second chamber to rise. When the level of molten metal in the second chamber exceeds height H2, molten metal flows out of the second chamber and into another structure.

An alternative transfer style pump is disclosed in U.S. Published Application 2013/0101424, the disclosure of which is herein incorporated by reference. The pump comprises an elongated pumping chamber tube with a base end and an open top end. A shaft extends into the tube and rotates an impeller proximate the base end. The pumping chamber tube preferably has a length at least three times the height of the impeller. The base end includes an inlet and the top end includes a tangential outlet. Rotation of the impeller draws molten metal into the pumping chamber and creates a rotating equilibrium vortex that rises up the walls of the pumping chamber. The rotating vortex adjacent the top end exits the device via the tangential outlet.

BRIEF DESCRIPTION

Various details of the present disclosure are hereinafter summarized to provide a basic understanding. This summary is not an extensive overview of the disclosure, and is intended neither to identify certain elements of the disclosure, nor to delineate the scope thereof. Rather, the primary purpose of this summary is to present some concepts of the disclosure in a simplified form prior to the more detailed description that is presented hereinafter.

In accord with one aspect of the present exemplary embodiment, a molten metal pump comprising a refractory material body defining an elongated chamber is provided. The chamber is configured to receive a shaft and impeller assembly. The chamber includes an open top through which the shaft passes. The chamber further includes a bottom inlet. The impeller is located in or adjacent the inlet. The body further defines an elongated passage adjacent to the chamber. An opening provides fluid communication between the elongated passage and the elongated chamber. The elongated passage is in fluid communication at its top end with a discharge channel configured to direct molten metal at least substantially perpendicular to an elongated axis of the elongated chamber.

According to a second embodiment, a method for transferring molten metal from a vessel is provided. The method comprises disposing a molten metal pump having an elongated chamber in a bath of molten metal. The chamber is configured to receive a shaft and impeller assembly through an open top. The impeller is located in or adjacent to an inlet to the chamber. The body further includes an elongated passage adjacent to the chamber. An opening provides fluid communication between the elongated passage and the elongated chamber. The elongated passage is in fluid communication with a discharge channel configured to direct molten metal at least substantially perpendicular to the elongated axis of the elongated chamber. Rotation of the impeller elevates molten metal within the elongated chamber and the elongated passage such that molten metal is selectively discharged from the pump via the discharge channel.

According to a further embodiment, a molten metal pump including a body comprised of a refractory material defining an elongated chamber and configured to receive a shaft and impeller assembly is provided. The chamber includes an open top through which the shaft passes and a bottom inlet. The impeller is located in or adjacent the inlet. The chamber is in fluid communication with a discharge channel located at a top end of the body and configured to direct molten metal at least substantially perpendicular to an elongated axis of the elongated chamber. The body also includes a plurality of rods having a first anchor end disposed in the body and a second attachment end secured to a pump support assembly. The rods also receive a compressible element configured for establishing a compressive force on the body. The tension supplying rods advantageously allow the pumping chamber to be formed and attached to the pump support assembly without use of a metal cladding. Elimination of a metal cladding allows the full length of the body to be immersible in a molten metal bath. In addition, the use of the tension supplying rods allows the pump body to be optionally constructed with a relatively small footprint. Accordingly, installation in space constrained regions of a furnace is a viable option.

BRIEF DESCRIPTION OF THE DRAWING

The following description and drawings set forth certain illustrative implementations of the disclosure in detail. The illustrated examples, however, are not exhaustive of the many possible embodiments of the disclosure.

DETAILED DESCRIPTION

The following description and drawings set forth certain illustrative implementations of the disclosure in detail. The illustrated examples, however, are not exhaustive of the many possible embodiments of the disclosure. Other advantages and alternative features of the invention will be apparent to the skilled artisan when considered in conjunction with the drawings.

Figure 1:
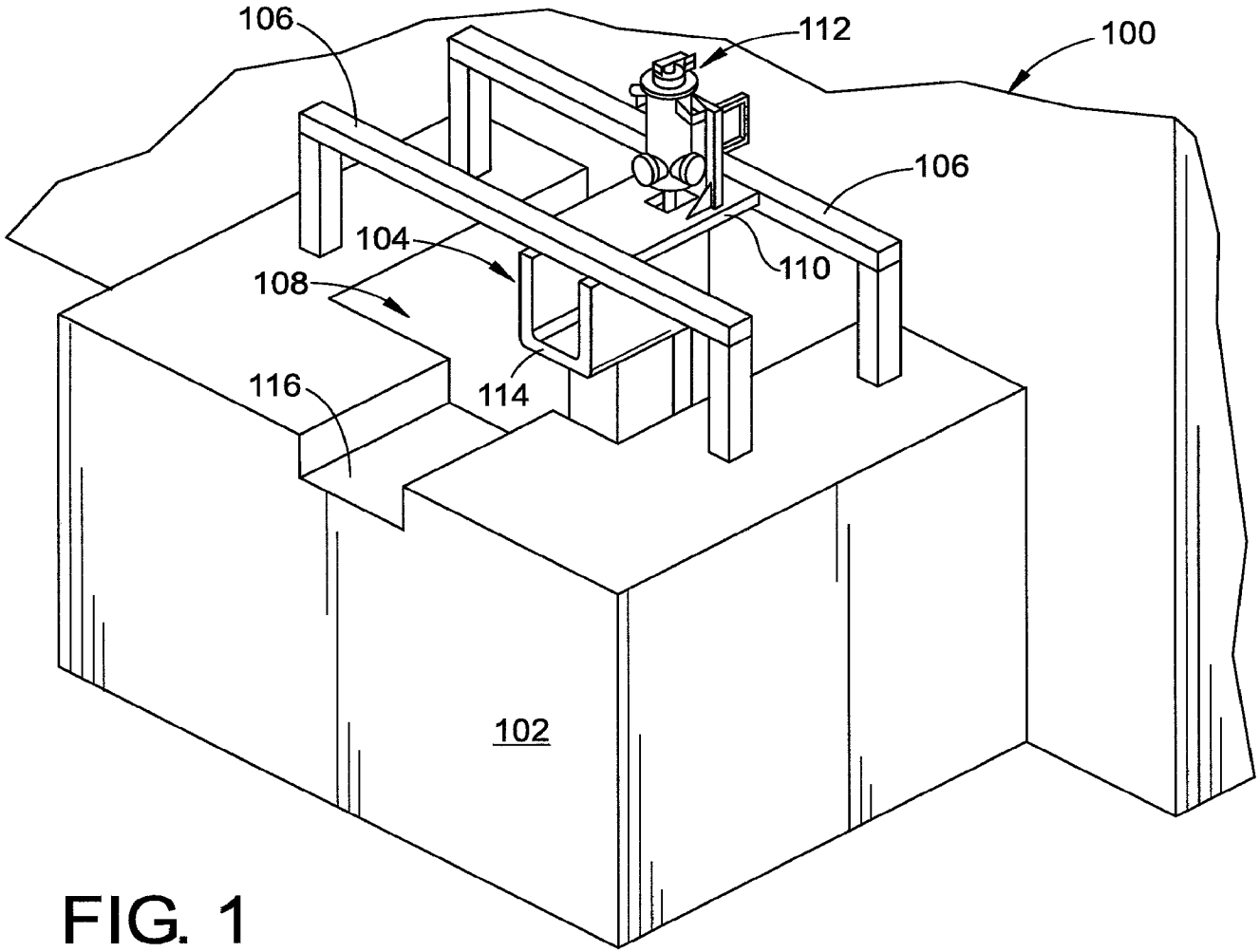
FIG. 1 is a perspective view of a molten metal transfer system including the pump of the present disclosure disposed in a furnace pump well.

Referring now to FIG. 1, a molten metal reverbatory furnace 100 is depicted. A pump well 102 extends from the reverbatory furnace and receives transfer pump 104 of the present disclosure. Pump 104 is suspended by a super structure including two beams 106. Pump 104 hangs into cavity 108 of the pump well 102. Cavity 108 receives molten metal from a main portion of reverbatory furnace 100 via a passage.

Beams 106 receive a motor mount 110 which supports motor 112 (air or electric). Pump 104 is suspended such that an inlet end (see FIGS. 2-5) can be disposed in molten metal contained in cavity 108 with a discharge channel 114 positioned adjacent or slightly above notch 116 formed in the wall of pump well 102. As a skilled artisan will discern, a tube or other launder assembly can be affixed to the discharge channel 114 and extend through the notch 116 to facilitate transport of molten metal out of the reverbatory furnace for delivery as desired. Of course, the assembly can also be positioned such that discharge channel 114 extends through the notch 116 and mates with a launder system externally to the pump wall. Advantageously this system does require lifting of the molten metal above the height of the exterior walls of the pump well.

Figure 2:
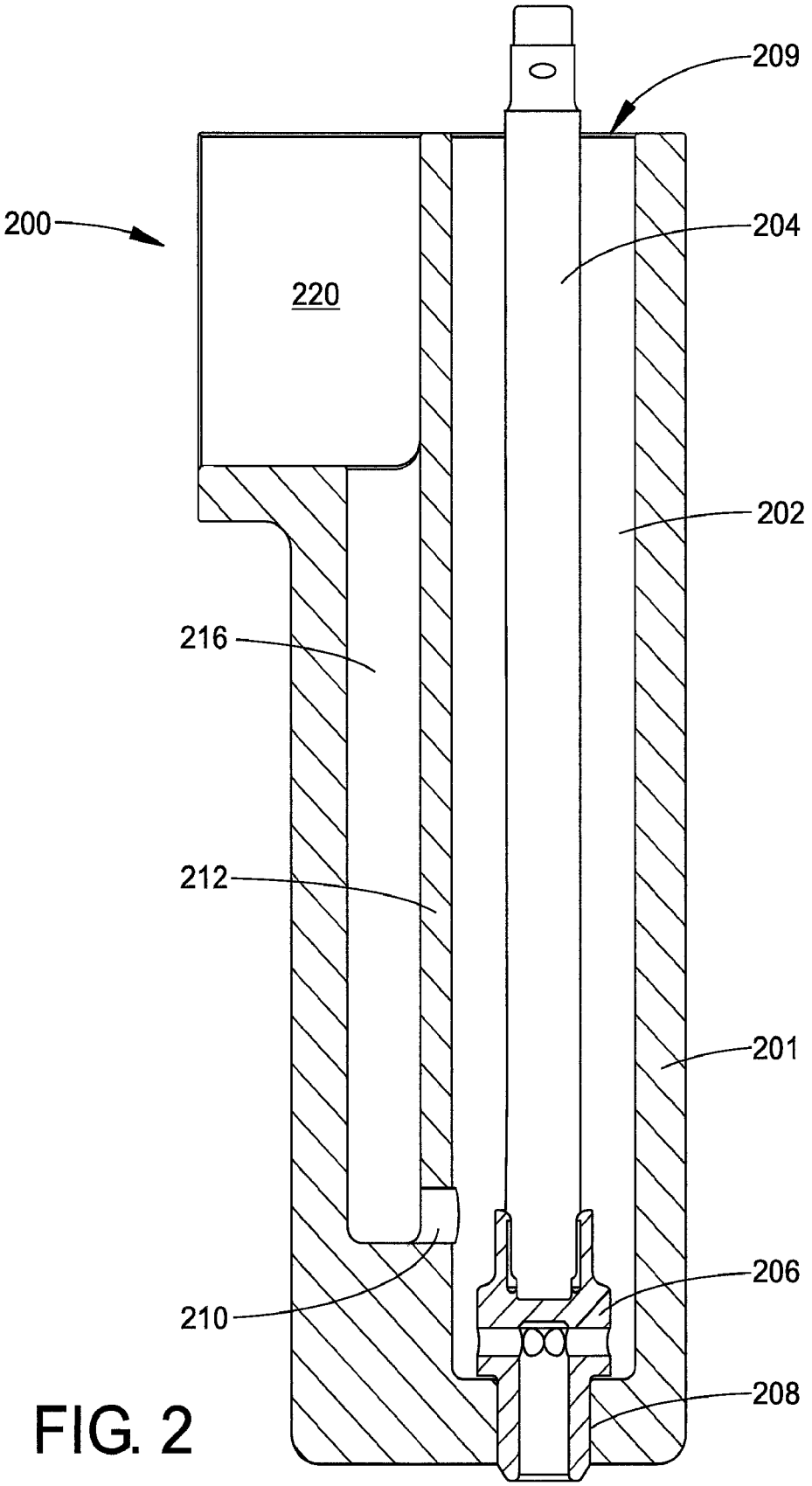
FIG. 2 is a cross-sectional view of the pump of FIG. 1.
Figure 3:
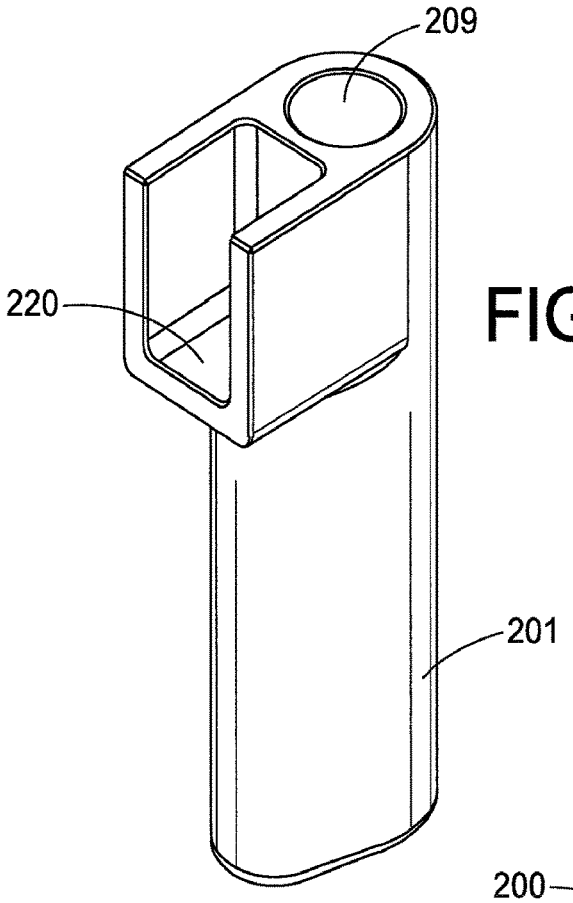
FIG. 3 is a perspective view of the pump body of FIGS. 1 and 2.
Figure 4:
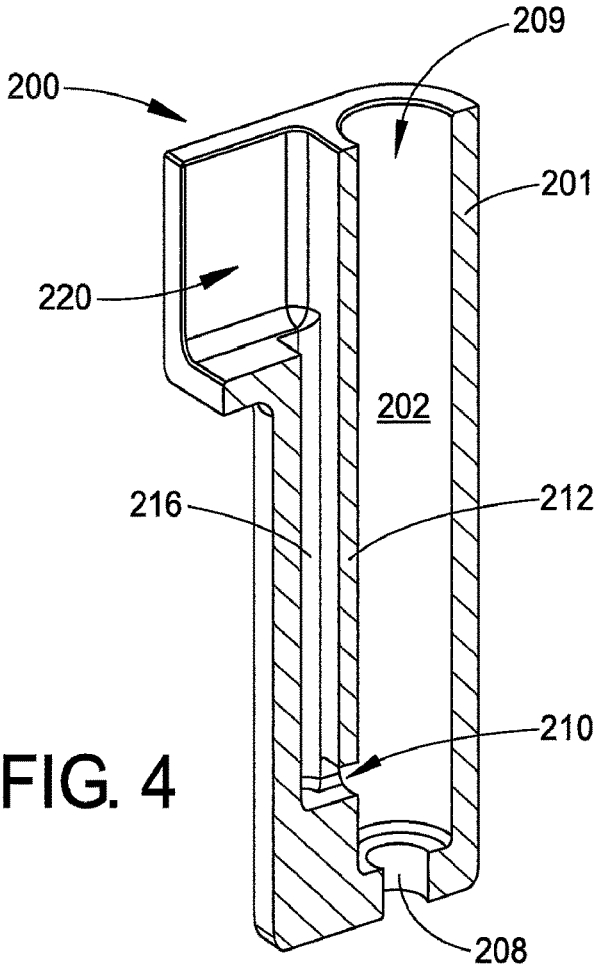
FIG. 4 is a perspective cross-sectional view of the pumping body of FIGS. 1-3.

Turning now to FIGS. 2-4, pump 200 includes a refractory body 201 constructed of ceramic or graphite, for example. Body 201 defines a first pumping chamber 202 which receives a shaft 204 and impeller 206. Impeller 206 can be disposed in (or adjacent) an inlet 208 formed in a lower portion of the pump body 201.

The inlet 208 can include a bearing surface (such as a bearing ring) receiving the impeller 206. The impeller 206 may include a corresponding bearing ring. The bearing surface can be an inward face of the inlet and the impeller bearing surface can be a radially external surface of the impeller snout, for example. The impeller can be a bottom inlet, side outlet type.

The impeller can also include a top plate. Moreover, it is believed that a top plate can provide a more gradual upward flow of molten metal within the pumping chamber. This more gradual upward flow can be demonstrated by a relatively minimal (or substantially zero) vortex (see line 306 in FIG. 5) being formed in the pumping chamber.

The impeller is advantageously controllable with respect to the quantity of molten metal it transfers per RPM. In this regard, the impeller can have a flow rate per RPM that is relatively slow but provides the head necessary to lift the molten metal within the pumping chamber. For example, the impeller can provide an increase of molten metal throughput of between about 1 and 2 pounds per minute for a single unit increase in RPM.

Shaft 204 and impeller 206 can be inserted into pumping chamber 202 via open top 209. While the shaft/impeller assembly is depicted as centrally located within the chamber it is envisioned that an off center location may also function adequately.

An opening 210 is formed in a side wall 212 of the pumping chamber 202. The opening 210 is in fluid communication with an elongated passage 216 running adjacent and generally parallel to the pumping chamber 202. The largest cross-section of the elongated passage 216 can be less than a largest cross-section of the pump chamber 202. The pumping chamber 202 and the elongated passage 216 can each be at least substantially cylindrical and a diameter of the elongated passage 216 can be less than a diameter of the pumping chamber 202.

Elongated passage 216 is in fluid communication with a discharge channel 220 oriented to direct flowing molten metal perpendicularly away from an elongated axis of the pumping chamber 202.

Opening 210 can be located at a first end of the elongated passage 216 and the discharge channel 220 located at an opposed end of the elongated passage 216. Opening 210 can be relatively smaller in cross-section (and/or diameter) than either passage 216 or pumping chamber 202 to reduce turbulence within passage 216. The opening can be located closer to the bottom inlet than to the open top. The center of the opening can be located above the outlets of the impeller. While opening 210 can theoretically be located at a location horizontally adjacent the impeller 206, locating opening 210 vertically above impeller 206 is believed to advantageously reduce turbulence in passage 216. Opening 210 can be located at any height along the length of the pumping chamber. However, it is also noted that spacing the opening too far above the impeller may be undesirable because providing a length to the passage 216 between opening 210 and discharge channel 220 which is at least 50% of the length of the pumping chamber 202 provides a beneficial calming zone. The opening 210 can be between approximately 10 and 50%, or between 15 and 30%, of the length of the pumping chamber above a lower most portion of the inlet 208.

Figure 5:
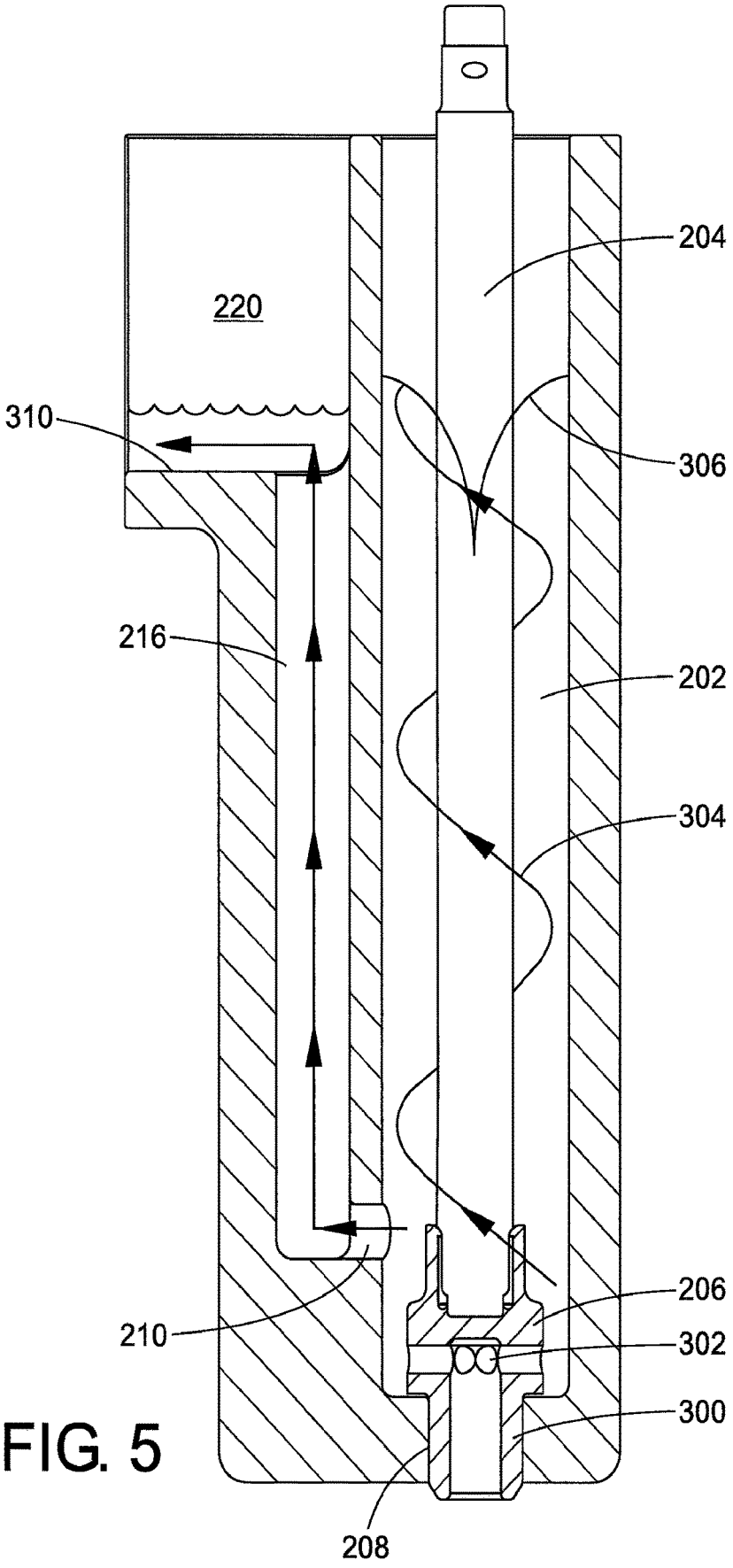
FIG. 5 is a schematic illustration of molten metal flow within the pump of FIGS. 1-4.

Turning now to FIG. 5, molten metal flow of the operating pump is depicted. As illustrated, upon rotation of the shaft 204 and impeller 206, molten metal is drawn into an impeller snout 300 which penetrates inlet 208. Molten metal enters the impeller and is radially discharged via impeller outlets 302. An upward flow or lifting of molten metal within pumping chamber 202 is achieved (see arrow 304). Depending on the impeller design and speed of rotation such flow may be of an equilibrium vortex style (wherein molten metal rotates and rises at least slightly higher adjacent the walls of the chamber than adjacent the shaft—see line 306) or without a vortex wherein the molten metal rises with limited rotation.

Rotation of the shaft 204 and impeller 208 and upward lifting of the molten metal within pumping chamber 202 creates a simultaneously lifting of molten metal in passage 216; wherein molten metal accesses passage 216 through opening 210. The molten metal height within the passage 216 is typically substantially equal to or slightly below the level of molten metal within the pumping chamber 202.

When molten metal rises in the passage 216 to a height reaching a floor 310 of the discharge channel 220, molten metal flows outwardly from the pump to an associated launder or other transfer mechanism for delivery to a ladle, casting apparatus or other desired location. Advantageously, the entire pump assembly below the motor can be immersed in the molten metal.

Figure 6:
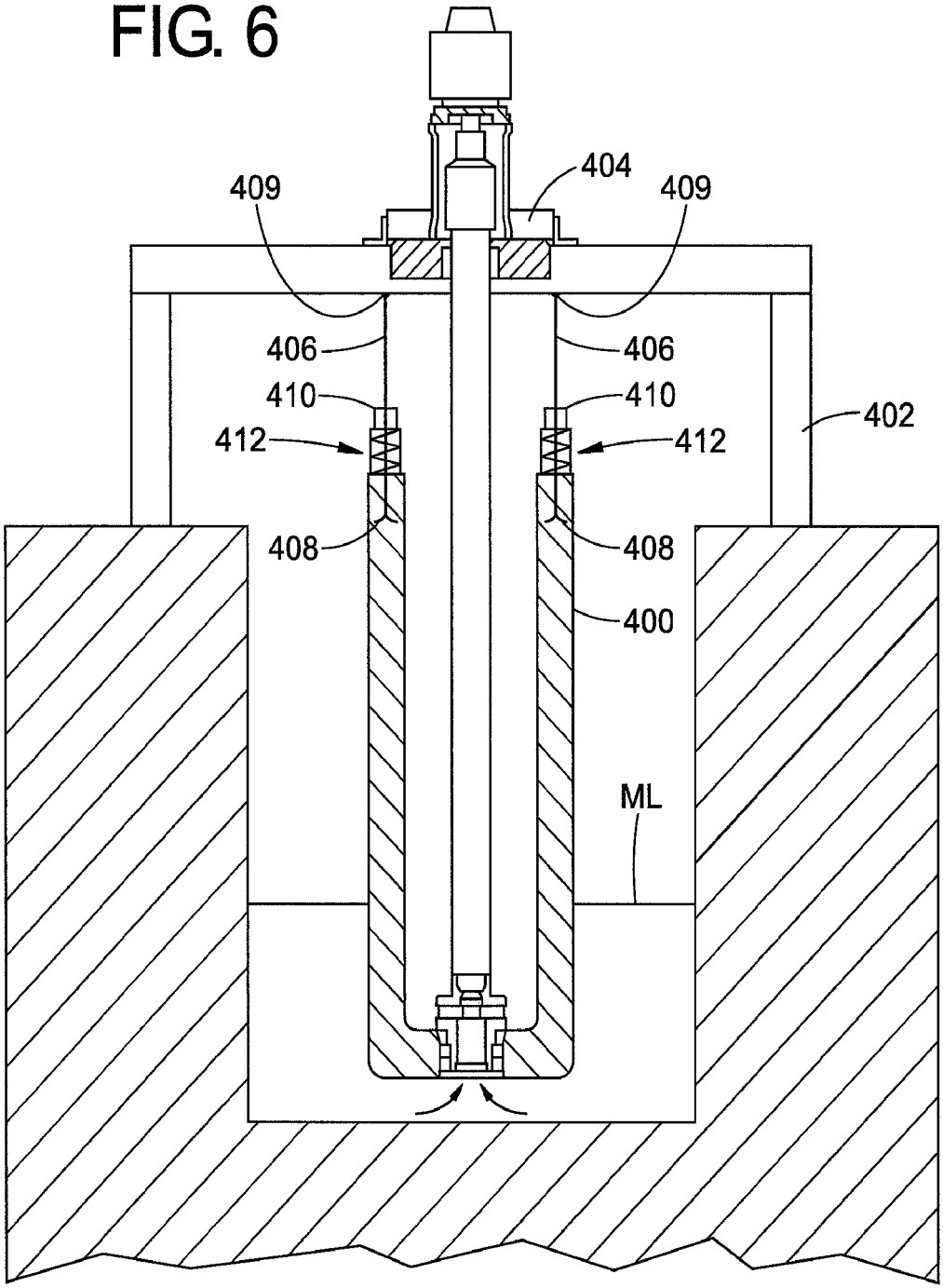
FIG. 6 is a cross-sectional view of an alternative mounting arrangement for the molten metal pump of the present disclosure.

Turning now to FIG. 6, a further alternative configuration is provided wherein the molten metal pump body 400 is secured to a super structure 402 or motor mount 404 via rods 406. Rods 406 include a first end including mounting anchors 408 which can be cast into the pump body or secured therein, for example, via side notches or longitudinal insertion with rotation into a locking engagement, etc. A second end 409 of each rod is secured in a convention manner to the superstructure 402 or motor mount 404. Rods 406 can include a threaded external surface receiving nuts 410 which facilitate the application of a compressive force on the pump body via inclusion of intermediate spring assemblies 412.

While the anchor assemblies 408 are depicted relatively close to the top surface of the pump body 400, it may be desirable to locate the anchors lower on the pump body (for example at the metal level ML) to provide compressive forces over a greater surface area of the pump body.

Optionally, a launder or other structure for transferring molten metal will be secured to the discharge channel. The launder may be either an open or enclosed channel, trough or conduit and may be of any suitable dimension or length, such as one to four feet long, or as much as 100 feet long or longer. The launder may have one or more taps (not shown), i.e., small openings stopped by removable plugs.

The pump motor is preferably a variable speed motor. The system may be automated by utilizing a float in the ladle, a scale that measures the combined weight of the ladle and the molten metal inside the ladle, or a laser to measure the surface level of molten metal in the launder or other location in the operation, as an example. When the amount of molten metal in one part of the system is determined to be relatively low, the pump can be automatically adjusted to operate at a relatively faster speed to cause molten metal to flow more quickly out of the pump and ultimately into the structure to be filled. When the amount of molten metal in the structure (such as a ladle) reaches a desired level, the pump can be automatically slowed and/or stopped.

The speed of the pump can be reduced to a relatively low speed to keep the level of molten metal statically positioned in the elongated passage at an elevated height but below a height at which molten metal reaches the discharge channel. Advantageously, this maintains the temperature of the pump body at an elevated level and reduces thermal shock on the components when full pump operation is resumed.

A single pump could simultaneously feed molten metal to multiple (i.e., a plurality) of structures, or alternatively be configured to feed one of a plurality of structures depending upon the placement of one or more dams to block the flow of molten metal into the one or more structures.

A control system can be provided. The control system may provide proportional control such that the speed of the molten metal pump is proportional to the amount of molten metal required by a structure. The control system could be customized to provide a smooth, even flow of molten metal to one or more structures such as one or more ladles or ingot molds with minimal turbulence and little chance of overflow.

A control screen may be used with the system. The control screen could include, for example, an "on" button, a "metal depth" indicator allowing an operator to determine the depth of the molten metal as measured by a remote device, an "emergency on/off" button allowing an operator to stop the molten metal pump, an RPM indicator and/or an AMPS indicator to determine an electric current to the motor of molten metal pump.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molten metal pump comprising a body defining an elongated chamber, said elongated chamber configured to receive a shaft and impeller assembly, said body comprised of a refractory material, said elongated chamber including an open top through which said shaft passes and a bottom inlet, said inlet including a bearing surface receiving the impeller, said impeller being located in or adjacent said inlet, said body including an elongated passage adjacent to said chamber, an opening providing fluid communication between said elongated passage and said elongated chamber, said opening being dispersed such that a point of intersection with the elongated chamber is vertically above outlets in said impeller, and wherein said elongated passage is in fluid communication with a discharge channel configured to direct molten metal at least substantially perpendicular to an elongated axis of the elongated chamber.

2. The molten metal pump of claim 1 wherein said passage is at least substantially parallel to said chamber.

3. The molten metal pump of claim 1 wherein said inlet bearing surface comprises an internal face of the inlet and an impeller bearing surface comprises a radially outward surface of an impeller snout.

4. The molten metal pump of claim 3 wherein said impeller includes a bottom inlet, side outlets and a top plate.

5. The molten metal pump of claim 1 wherein a largest cross-section of said elongated passage is less than a largest cross-section of said elongated chamber.

6. The molten metal pump of claim 5 wherein a largest cross-section of said opening is less than a smallest cross-side of said passage.

7. The molten metal pump of claim 1 wherein said body is comprised of ceramic.

8. The molten metal pump of claim 1 wherein each of said chamber and said passage are at least substantially cylindrical and wherein a diameter of said elongated passage is less than a diameter of said elongated chamber.

9. The molten metal pump of claim 1 wherein said opening is located closer to said bottom inlet than to said open top.

10. The molten metal pump of claim 1 further including elongated rods disposed within said body, said rods including mechanisms imparting a compressive force on the body.

11. The molten metal pump of claim 10 wherein said elongated rods are suspended from a motor mount.

12. The molten metal pump of claim 1 wherein said body is comprised of a unitary, integral, one-piece cast ceramic construction.

13. The molten metal pump of claim 1 wherein said body is comprised of a unitary, integral one-piece machined graphite construction.

14. The molten metal pump of claim 1 wherein a bottom wall of said discharge channel is disposed below an upper surface of the body defining said open top.

15. A method for transferring molten metal from a vessel, the method comprising disposing a molten metal pump in a bath of molten metal, said pump comprising a refractory material body defining an elongated chamber, said elongated chamber configured to receive a shaft and impeller assembly through an open top and position said impeller in or adjacent an inlet to said chamber, said body including an elongated passage oriented adjacent to said elongated an opening above the above the impeller providing fluid communication between said elongated passage and said elongated chamber, and wherein said elongated passage is in fluid communication with a discharge channel configured to direct molten metal at least substantially tangential to the elongated axis of the elongated chamber, and wherein rotation of said impeller elevates molten metal within said elongated chamber to a level above the opening and said elongated passage such that molten metal is selectively discharged from said pump via said discharge channel.

16. The method of claim 15 wherein the molten metal rises substantially in equilibrium within the elongated chamber and the elongated passage when an adequate speed of rotation of the impeller is initiated.

17. A molten metal pump comprising a body defining an elongated chamber, said chamber configured to receive a shaft and impeller assembly, said body comprised of a refractory material, said chamber including an open top through which said shaft passes and a bottom inlet, said impeller being located in or adjacent said inlet, and wherein said chamber is in fluid communication with a discharge channel located at a top end of said body and configured to direct molten metal at least substantially perpendicular to an elongated axis of the elongated chamber, and wherein said body includes a plurality of rods having a first anchor end disposed in said body and a second attachment end secured to a pump support assembly, said rods further receiving a compressible element configured for establishing a compressive force on said body, said compressible element comprising a spring and nut assembly.

* * * * *